US008912965B2

(12) United States Patent
Kaneko et al.

(10) Patent No.: US 8,912,965 B2
(45) **Date of Patent: *Dec. 16, 2014**

(54) SUBSTRATE ANTENNA

(75) Inventors: Tutomu Kaneko, Tokyo (JP); Takahisa Karakama, Nakano (JP)

(73) Assignees: NISSEI Limited, Tokyo (JP); Faverights, Inc., Nakano-shi (JP)

( * ) Notice: Subject to any disclaimer, the term of this patent is extended or adjusted under 35 U.S.C. 154(b) by 92 days.

This patent is subject to a terminal disclaimer.

(21) Appl. No.: 13/483,557

(22) Filed: May 30, 2012

(65) Prior Publication Data

US 2012/0306702 A1 Dec. 6, 2012

(30) Foreign Application Priority Data

May 31, 2011 (JP) ..... 2011-122344

(51) Int. Cl.

| | |
|---|---|
| ***H01Q 19/06*** | (2006.01) |
| ***H01Q 1/38*** | (2006.01) |
| ***H01Q 9/42*** | (2006.01) |
| ***H01Q 5/00*** | (2006.01) |

(52) U.S. Cl.

CPC ..... *H01Q 9/42* (2013.01); *H01Q 5/0065* (2013.01)

USPC ..... 343/753; 343/700 MS

(58) Field of Classification Search

CPC ..... H01Q 1/38; H01Q 1/243; H01Q 9/42; H01Q 7/00; H01Q 5/0058

USPC ..... 343/700 MS, 788, 866

See application file for complete search history.

(56) References Cited

U.S. PATENT DOCUMENTS

| | | | | |
|---|---|---|---|---|
| 7,218,282 | B2 * | 5/2007 | Humpfer et al. | 343/700 MS |
| 7,369,094 | B2 * | 5/2008 | Song et al. | 343/816 |
| 7,528,788 | B2 * | 5/2009 | Dunn et al. | 343/795 |
| 7,616,158 | B2 * | 11/2009 | Mak et al. | 343/700 MS |
| 8,081,125 | B2 * | 12/2011 | Dokai et al. | 343/702 |
| 2010/0060526 | A1 * | 3/2010 | Cheng | 343/700 MS |

FOREIGN PATENT DOCUMENTS

| | | |
|---|---|---|
| JP | 2007-142666 A | 6/2007 |

* cited by examiner

*Primary Examiner* — Dameon E Levi
*Assistant Examiner* — Hasan Islam
(74) *Attorney, Agent, or Firm* — Crowell & Moring LLP

(57) ABSTRACT

The simply configured substrate antenna has a plurality of antennas. A loop-like first joint pattern one spot of which is divided is formed in one-side substrate surface of a substrate composed of a dielectric material. Antenna elements that configure a first antenna are respectively connected to both ends of the first joint pattern at the divided position. A loop-like second joint pattern one spot of which is divided is formed in the other-side substrate surface at a position opposite to the first joint pattern. Antenna elements that configure a second antenna are respectively connected to both ends of the second joint pattern at the divided position. The first and second antennas are set to approximately the same or different resonance frequency bands. Feeding and ground points connected to and formed in the first joint pattern are held in common to transmit or receive a transmission/reception signal.

4 Claims, 3 Drawing Sheets

SUBSTRATE ANTENNA

CLAIM OF PRIORITY

The present invention claims priority based on Japanese Patent Application No. 2011-122344 filed in Japanese Patent Office on May 31, 2011. The subject matter of this priority document is incorporated by reference herein.

BACKGROUND OF THE INVENTION

1. Field of the Invention

The present invention relates to a substrate antenna that configures antennas on a thin substrate.

2. Description of the Related Art

As a related art substrate antenna, there has been known one configured so as to have a substrate comprised of a dielectric material, a loop-like first joint pattern formed in one substrate surface of the substrate and divided at one spot thereof, and a loop-like second joint pattern which is formed in the other substrate surface thereof and divided at one spot thereof and whose divided both ends are respectively connected with a feeding point, and to electrostatic capacitively-couple and magnetic inductively-couple between the first joint pattern and the second joint pattern and connect an antenna to one end of the first joint pattern. According to such a configuration, the states of electrostatic capacitive-coupling and magnetic inductive-coupling between the patterns by the substrate are greatly improved, and a high-frequency coupler excellent in characteristic as compared with the related art can easily be obtained (refer to, for example, Japanese Patent Publication No. 2007-142666).

SUMMARY OF THE INVENTION

Since there was only a way of thinking that an antenna having one resonance frequency band was configured on a sheet of substrate in the case of the related art substrate antenna, it was not possible to take full advantage of the effect of using a thin substrate.

An object of the present invention is to provide a substrate antenna having a plurality of antennas configured on a thin substrate in a simple configuration.

In order to achieve the above object, the present invention provides a substrate antenna that includes a loop-like first joint pattern one spot of which is divided, which is formed in a one-side substrate surface of a substrate comprised of a dielectric material; antenna elements that configure a first antenna, which are respectively connected to both ends of the first joint pattern at a position where the first joint pattern is divided, to thereby transmit and receive transmission and reception signals from a feeding point and an earth point formed on the substrate. In the substrate antenna, a loop-like second joint pattern one spot of which is divided is formed in the other-side substrate surface of the substrate at a position opposite to the first joint pattern, and antenna elements that configure a second antenna are respectively connected to both ends of the second joint pattern at a position where the second joint pattern is divided. The first antenna and the second antenna are capable of transmitting and receiving transmission and reception signals from the feeding point and the earth point shared in common.

According to such a configuration, a first joint pattern and a second joint pattern are electrostatic capacitively-coupled via the electrostatic capacitance of the substrate and magnetic inductively-coupled. Although a single sheet of thin substrate is configured apparently, two first and second antennas can be obtained in a simple configuration. Further, since transmission and reception signals can be transmitted and received from common feeding and earth points, an overall configuration can be simplified.

According to the present invention as well, in addition to the above configuration, the first antenna and the second antenna are capable of transmitting and receiving transmission and reception signals lying in different resonance frequency bands respectively from the feeding point and the earth point both shared in common.

According to such a configuration, a first joint pattern and a second joint pattern are electrostatic capacitively-coupled via the electrostatic capacitance of a substrate and magnetic inductively-coupled. Although a single sheet of substrate is taken apparently, a first antenna and a second antenna can be configured for two different resonance frequency bands respectively. Further, since transmission and reception signals lying in two different resonance frequency bands can be transmitted and received from common feeding and earth points.

Further, according to the present invention, in addition to the above configuration, another substrate is disposed in such a manner that a loop-like third joint pattern one spot of which is divided is placed in the position opposite to the first joint pattern. Antenna elements that configure a third antenna are respectively connected to both end sides of the third joint pattern at the divided position of the third joint pattern. The first antenna, the second antenna and the third antenna are capable of transmitting and receiving transmission and reception signals respectively from the feeding point and the earth point shared in common.

According to such a configuration, although two sheets of thin substrates are bonded to each other, three first, second and third antennas can be configured while the two substrates serve like a single sheet of thin substrate apparently. Further, since transmission and reception signals can be transmitted and received from common feeding and earth points, a substrate antenna can be brought to a simple configuration as a whole.

According to the present invention, in addition to the above configuration, the first antenna, the second antenna and the third antenna are capable of transmitting and receiving transmission and reception signals having different resonance frequencies respectively from the feeding point and the earth point shared in common.

According to such a configuration, a feeding point and an earth point can be shared in common to enable three sets of antennas different in resonance frequency band to be configured in a simple configuration. Thus, a combined gain in frequency bands respectively different in gain peak can be obtained from the feeding point and the earth point.

According to a substrate antenna according to the present invention, a first joint pattern and a second joint pattern are electrostatic capacitively-coupled via the electrostatic capacitance of a substrate and magnetic inductively-coupled. Although a single sheet of thin substrate is configured apparently, two first and second antennas can be obtained in a simple configuration. Further, since transmission and reception signals can be transmitted and received from a feeding point and an earth point both shared in common, an overall configuration can be simplified.

Other features and advantages of the present invention will become apparent upon a reading of the attached specification.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENTS

Preferred embodiments of the present invention will be explained hereinafter with reference to the accompanying drawings.

Figure 1:
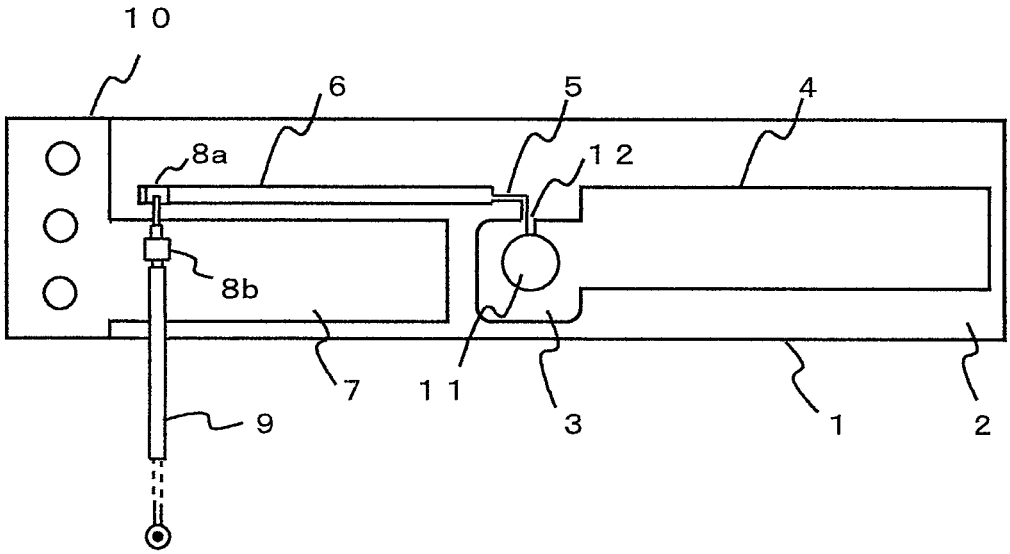
FIG. 1 is a plan view showing a one-side substrate surface of a substrate antenna according to one embodiment of the present invention.
Figure 2:
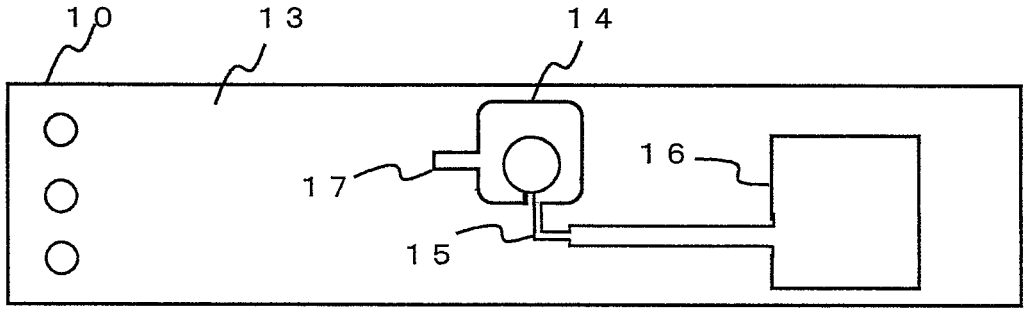
FIG. 2 is a plan view illustrating the other-side substrate surface of the substrate antenna shown in FIG. 1.

FIGS. 1 and 2 are plan views respectively showing a one-side substrate surface of a substrate antenna according to one embodiment of the present invention and the other-side substrate surface thereof. A substrate 1 is fabricated by a dielectric material, for example, a glass epoxy material. A loop-shaped, e.g. approximately C-shaped first joint pattern 3 one spot of which being divided as shown in FIG. 1 is formed in a one-side substrate surface 2 of the substrate 1. Both ends of the first joint pattern 3 where it is divided are connected with an antenna element 4 that configures a first antenna and an antenna element 6 via an electric path 5. A feeding point 8*a* is formed on the first antenna, e.g., at the other end of the antenna element 6. An earth portion 7 for stabilizing a potential supplied to the feeding point 8*a* is disposed in the neighborhood of the feeding point 8*a*. An earth point 8*b* is formed in the earth portion 7. A center-part signal line of a coaxial cable 9 is connected to the feeding point 8*a*, and an outer peripheral-portion shielded wire of the coaxial cable 9 is connected to the earth point 8*b*. A mounting portion 10 having a plurality of substrate mounting holes is formed at one end of the substrate 1. The first antenna configures a monopole type antenna between the feeding point 8*a* and the earth point 8*b* in the above-described manner.

The substrate 1 has outer dimensions which are 0.3 mm in thickness, 101 mm in length and 25 mm in width and is formed in a rectangular fashion. The first joint pattern 3 has a circular cut-away portion 11 of 6 mm or so at its central part. A gap 12 of 0.5 mm or so is formed between the divided ends. The antenna element 4 is 43.75 mm in length and 13 mm or so in width. The antenna element 6 is 37 mm in length and 2 mm in width. Here, the resonance frequency band of the first antenna comprised of the antenna element 4 and the antenna element 6 is, for example, an 800 MHz band, particularly, from 800 MHz to 975 MHz.

The other-side substrate surface 13 of the same substrate 1 has a second joint pattern 14 of approximately the same loop shape, which is aligned with the first joint pattern 3 in its divided position as shown in FIG. 2. Both ends of the second joint pattern 14 where it is divided are connected with an antenna element 17 that configures a second antenna and an antenna element 6 via an electric path 5. Here, the antenna element 17 is formed at the outer peripheral portion of the second joint pattern 14 so as to protrude outside and configured so as to be capable of easily fine-adjusting the resonance frequency by changing the length of its protrusion. It is however not only this configuration, but can be formed at the divided one end of second joint pattern 14.

The second joint pattern 14 is approximately identical in shape to the first joint pattern 3. The antenna element 16 that configures the second antenna is 20 mm in length and 24 mm or so in width. The antenna element 17 is 3 mm in length and 1.5 mm or so in width. The resonance frequency band of the above-described second antenna is different from the frequency band of the first antenna and is, for example, a 2 GHz band, particularly, from 1700 MHz to 2200 MHz. The frequency bands of both antennas are however not limited to those illustrated by way of example, but both are set to at least different frequency bands.

Thus, using the single sheet of thin substrate 1 in this manner, the first joint pattern 3 formed in the one-side substrate surface 2 and the second joint pattern 14 formed in the other-side substrate surface 13 are electrostatic capacitively-coupled via the electrostatic capacitance of the substrate 1 and magnetic inductively-coupled. Thus, although the single sheet of thin substrate 1 is configured apparently, it enables a monopole type antenna that configures the two first and second antennas and transmits and receives signals lying in two different frequency bands from the feeding point 8*a* and the earth point 8*b* shared in common.

Since the resonance frequency band can be changed by changing the length and shape of each antenna element in this type of monopole type antenna, it is possible for the monopole type antenna to transmit or receive the signals lying in the two different frequency bands without complicating its overall configuration. Further, since the second joint pattern 14 disposed opposite to the first joint pattern 3 is formed with the antenna element 17 that projects outside, it is possible to easily fine-adjust the frequency by changing the length of the third antenna element 17 when the frequency is fine-adjusted.

Figure 3:
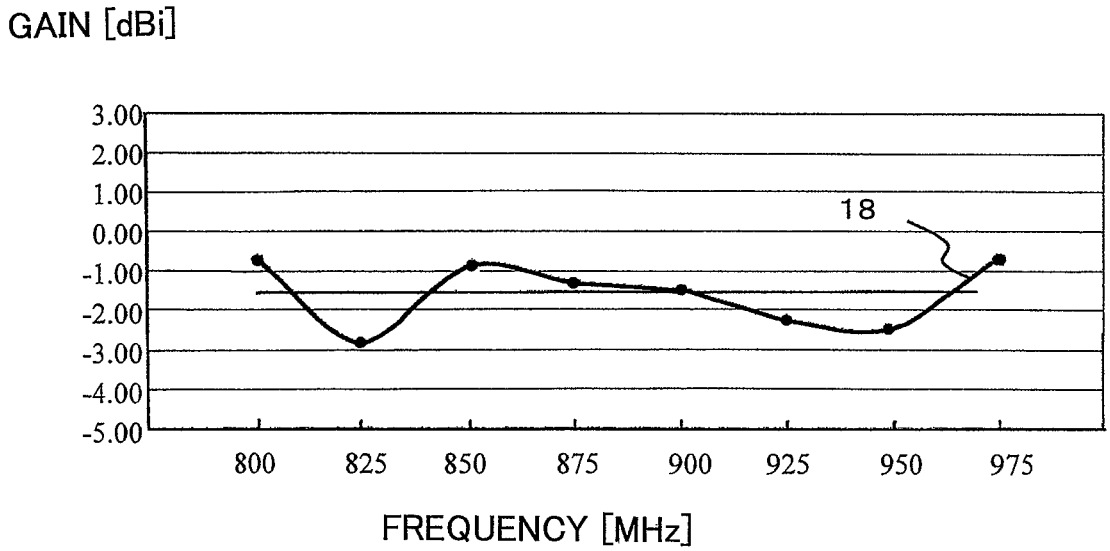
FIG. 3 is a gain characteristic diagram of one antenna shown in FIG. 1.
Figure 4:
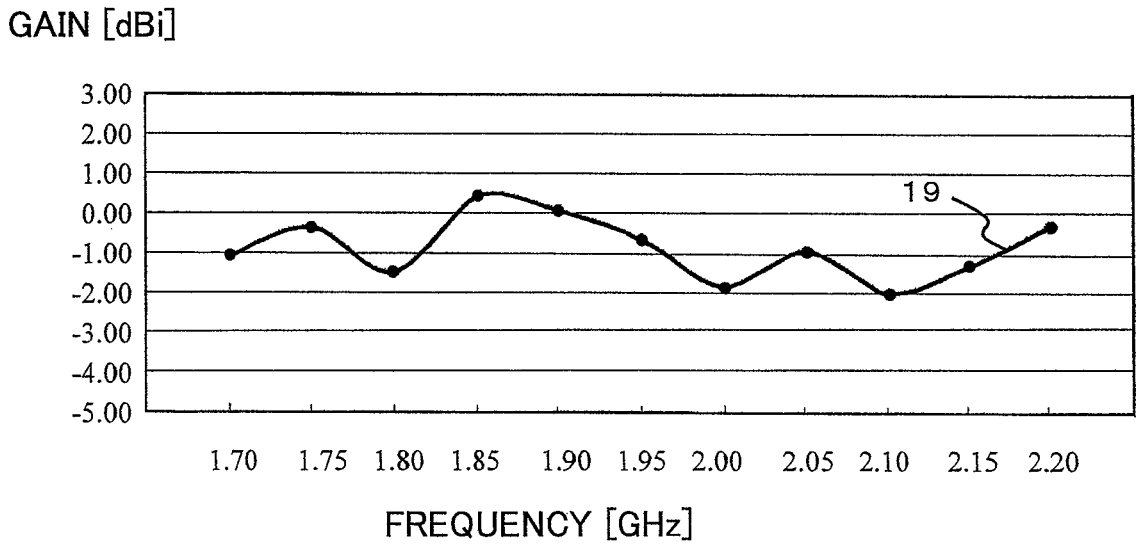
FIG. 4 is a gain characteristic diagram of another antenna shown in FIG. 2.

When the first antenna comprised of the above-described antenna elements 4 and 6 is designed to have a 800 MHz band as its resonance frequency, the gain of the first antenna itself is represented as such a frequency gain characteristic curve 18 as shown in FIG. 3. When the second antenna comprised of the above-described antenna elements 16 and 17 is designed to have a 2 GHz band as its resonance frequency, the gain of the second antenna itself is represented as such a frequency gain characteristic curve 19 as shown in FIG. 4. When, however, the sizes and the like of the respective joint patterns 3 and 14 are so designed that the gains of both antennas are respectively received at a characteristic impedance of 50Ω from the feeding points 8*a* and the earth portion 8*b*, the gain of the first antenna itself and the gain of the second antenna itself can be received from the feeding point 8*a* and the earth portion 8*b* in the form of being combined together.

Thus, according to the above-described substrate antenna, although the present antenna is of the simple single sheet of thin substrate antenna apparently, the substrate antenna can configure the first and second antennas. Further, the combined gain in the two different resonance frequency bands in which the gain's peaks respectively indicate an 800 MHz band and a 2 GHz band can be obtained by sharing the use of the feeding point 8*a* and the earth point 8*b*.

In the substrate antenna according to the above-described embodiment, the antenna elements 4 and 6 configure the first antenna at the one-side substrate surface 2, the antenna elements 16 and 17 configure the second antenna at the other-side substrate surface 13, and the resonance frequencies of both antennas are rendered different from each other. The present embodiment can be applied even to one identical in configuration and approximately made identical in terms of resonance frequencies of both antennas.

Assume that, for example, a model in which the gain is about 1.7 dB when the resonance frequency of the first antenna itself is adjusted to a given value, and a model in which the gain is about 1.0 dB when the resonance frequency of the second antenna itself is adjusted to the same value, are combined together as shown in FIGS. 1 and 2. Further, assuming that the sizes and the like of the respective joint patterns 3 and 14 are so designed that the gains of both antennas can be received at the characteristic impedance of 50 ohms from the common feeding point 8*a* and earth point 8*b*, the resonance frequencies are identical but a high gain of about 2.5 dB is obtained.

It is also possible to achieve band widening by the above-described configuration. Assume that, for example, a model in which the gain at the time that the resonance frequency of the first antenna configured by the antenna elements 4 and 6 is adjusted to 948 MHz is about 1.0 dB, and a model in which the gain at the time that the resonance frequency of the second antenna itself configured by the antenna elements 16 and 17 is adjusted to 956 MHz, is about 0.7 dB, are combined together as shown in FIGS. 1 and 2. When the sizes and the like of the respective joint patterns 3 and 14 are so designed that the gains of both antennas can be received at the characteristic impedance of 50 ohms from the common feeding point 8*a* and earth point 8*b*, a high gain of about 1.2 dB is obtained when the resonance frequency is defined in a broad band ranging from 948 MHz to 956 MHz.

Thus, in the substrate antenna in which the loop-like first joint pattern 3 one spot of which is divided, is formed in the one-side substrate surface 2 of the substrate 1 comprised of the dielectric material, the antennas 4 and 6 that configure the first antenna are respectively connected to both ends of the first joint pattern 3 at the position where it is divided, and the transmission and reception signals are transmitted and received from the feeding point 8*a* and the earth point 8*b* formed on the substrate 1, the loop-like second joint pattern 14 one spot of which is divided is formed in the other-side substrate surface 13 of the substrate 1 at the position opposite to the first joint pattern 3, and the antenna elements 16 and 17 that configure the second antenna are respectively connected to both ends of the second joint pattern 14 at the position where it is divided. Then the first antenna and the second antenna are configured to be capable of transmitting and receiving the transmission and reception signals each having approximately the same resonance frequency from the common feeding point 8*a* and earth point 8*b*. It is thus possible to easily configure the two antennas on the thin substrate 1 while using the common feeding point 8*a* and earth point 8*b*. Further, the two antennas are capable of achieving band widening at a high gain that is not obtained only by the single antenna.

Figure 5:
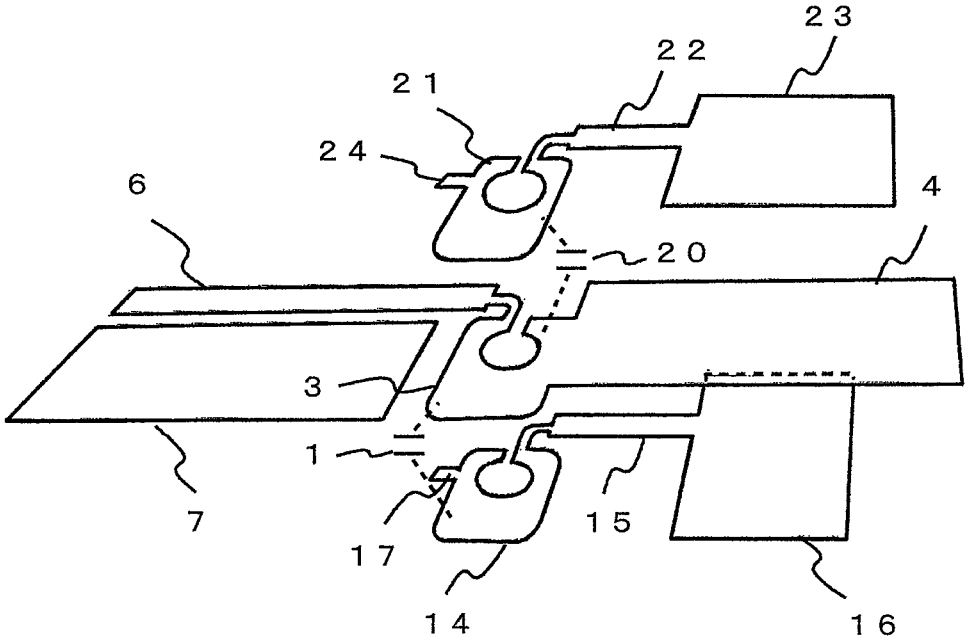
FIG. 5 is an exploded perspective view showing a substrate antenna according to another embodiment of the present invention.

FIG. 5 is a perspective view showing a substrate antenna according to another embodiment of the present invention. In the present embodiment, two sheets of substrates 1 and 20 each comprised of a thin dielectric material are used and both stacked on each other. Further, they are bonded to each other by an adhesive or other means, followed by being integrated into one. The first sheet of substrate 1 has the same configuration as in FIGS. 1 and 2 and is disposed with a one-side substrate surface 2 being pointed upwards. In the first sheet of substrate 1, the same reference numerals are respectively attached to components equal to those shown in the previous embodiment, and a detailed description thereof will be omitted.

On the other hand, the second sheet of substrate 20 is placed at above the first sheet of substrate 1. A loop-like third joint pattern 21 approximately identical to the first joint pattern 3 formed in the substrate 1 is formed in an opposite-side substrate surface located above the substrate 20. The position where the third joint pattern 21 is divided is brought approximately into alignment with that of the first joint pattern 3. Both ends of the third joint pattern 21 where it is divided are connected with an antenna element 24 that configures a third antenna and an antenna element 23 through an electric path 22. Although the antenna element 24 is formed at the outer peripheral portion of the third joint pattern 21 so as to protrude outside as with the above-described antenna element 17 of second antenna even here, the present embodiment is not limited to this structure.

The two sheets of thin substrates 1 and 20 are used in bonded form herein. Since, however, the substrate 20 having the third antenna is also of a thin type as with the previous embodiment, and the third antenna can be configured using the third joint pattern 21 coupled to the first joint pattern 3, the substrate antenna becomes thin as a whole.

Although such a substrate antenna is of the single sheet of thin substrate 1 apparently as described previously, signals lying in two different resonance frequency bands can be transmitted or received from the common feeding point 8*a* and earth point 8*b* using the two first and second antennas 4 and 16. In addition to that, the first joint pattern 3 formed in the substrate 1 and the third joint pattern 21 formed in the opposite-side substrate surface of the second sheet of substrate 20 shown in FIG. 5 are disposed opposite to each other. Hence the same feeding and earth points 8*a* and 8*b* are held in common to enable the transmission and reception of signals lying in a further third resonance frequency band. Thus, a combined gain in resonance frequency bands respectively different in gain peak can be obtained from the same common feeding point 8*a* and earth point 8*b*.

Incidentally, even in the configuration of the present embodiment, the three antennas are set approximately to the same resonance frequency band, thereby making it possible to achieve band widening at a high gain that is not obtained only by the antenna itself as with the above-described case. Although the respective antennas are disposed approximately in longitudinal alignment with each other in the respective embodiments described above, a tilt may be provided between the respective antennas.

While the preferred forms of the present invention have been described, it is to be understood that modifications will be apparent to those skilled in the art without departing from the spirit of the invention. The scope of the invention is to be determined solely by the following claims.

What is claimed is:

1. A substrate antenna comprising:

a loop-like first joint pattern, one spot of which is divided, the first joint pattern being formed in a one-side substrate surface of a substrate comprised of a dielectric material;

antenna elements that configure a first antenna, the antenna elements being respectively connected to both ends of the first joint pattern at a position where the first joint pattern is divided, to transmit and receive transmission and reception signals from a feeding point and an earth point formed on the substrate;

a second joint pattern having approximately a same loop-like shape as the first joint pattern, one spot of which is divided, the second joint pattern being formed in the other-side substrate surface of the substrate at a position opposite to the first joint pattern, wherein the first joint pattern and the second joint pattern are aligned with each other in their divided positions so as to be electrostatic capacitively-coupled via an electrostatic capacitance of the substrate and magnetic inductively-coupled; and antenna elements that configure a second antenna, the antenna elements being respectively connected to both ends of the second joint pattern at a position where the second joint pattern is divided, wherein the first antenna and the second antenna are capable of transmitting and receiving transmission and reception signals from the feeding point and the earth point shared in common.

2. The substrate antenna according to claim 1, wherein the first antenna and the second antenna are capable of transmitting and receiving transmission and reception signals lying in different resonance frequency bands respectively from the feeding point and the earth point both shared in common.

3. The substrate antenna according to claim 1, further comprising:

another substrate disposed in such a manner that a loop-like third joint pattern, one spot of which is divided is placed in the position opposite to the first joint pattern, and antenna elements that configure a third antenna, the antenna elements being respectively connected to both end sides of the third joint pattern at the divided position of the third joint pattern, wherein the first antenna, the second antenna and the third antenna are capable of transmitting and receiving transmission and reception signals respectively from the feeding point and the earth point shared in common.

4. The substrate antenna according to claim 3, wherein the first antenna, the second antenna and the third antenna are capable of transmitting and receiving transmission and reception signals having different resonance frequencies respectively from the feeding point and the earth point shared in common.

* * * * *